US007425225B2

(12) United States Patent
Genn et al.

(10) Patent No.: US 7,425,225 B2
(45) Date of Patent: Sep. 16, 2008

(54) EXHAUST ASSEMBLY

(75) Inventors: Stuart Lloyd Genn, Wiltshire (GB); Richard Anthony Mason, Wiltshire (GB)

(73) Assignee: Dyson Technology Limited, Wiltshire (GB)

( * ) Notice: Subject to any disclaimer, the term of this patent is extended or adjusted under 35 U.S.C. 154(b) by 214 days.

(21) Appl. No.: 10/504,058

(22) PCT Filed: Feb. 3, 2003

(86) PCT No.: PCT/GB03/00423

§ 371 (c)(1),
(2), (4) Date: Aug. 10, 2004

(87) PCT Pub. No.: WO03/068042

PCT Pub. Date: Aug. 21, 2003

(65) Prior Publication Data

US 2005/0066635 A1 Mar. 31, 2005

(30) Foreign Application Priority Data

Feb. 11, 2002 (GB) ..... 0203147.4

(51) Int. Cl.
*B01D 46/00* (2006.01)

(52) U.S. Cl. ..... 55/418; 15/347; 15/353; 55/471; 55/DIG. 3

(58) Field of Classification Search ..... 55/410, 55/413–418, DIG. 3, 471; 15/347, 353; 310/89, 310/90

See application file for complete search history.

(56) References Cited

U.S. PATENT DOCUMENTS

| | | | | | |
|---|---|---|---|---|---|
| 4,120,616 | A * | 10/1978 | Dwyer et al. | 417/373 |
| 4,195,969 | A * | 4/1980 | Whitney | 417/247 |
| 5,289,612 | A | 3/1994 | Glenn, III | |
| 5,296,769 | A * | 3/1994 | Havens et al. | 310/90 |
| 5,352,255 | A * | 10/1994 | Taft | 96/419 |
| 5,737,797 | A | 4/1998 | Rittmueller et al. | |
| 5,946,771 | A * | 9/1999 | Bosyj et al. | 15/347 |
| 5,961,676 | A * | 10/1999 | King et al. | 55/334 |
| 6,616,722 | B1 * | 9/2003 | Cartellone | 55/459.3 |
| 6,779,229 | B2 * | 8/2004 | Lee et al. | 15/329 |
| 2002/0088209 | A1 * | 7/2002 | Stephens et al. | 55/337 |

FOREIGN PATENT DOCUMENTS

| | | | |
|---|---|---|---|
| DE | EP-0289987 | A2 * | 3/1988 |
| EP | 0 042 723 | | 12/1981 |
| EP | 0 289 987 | | 11/1988 |
| JP | EP-0289987 | A2 * | 3/1988 |
| JP | EP - 0289987 | A2 * | 9/1988 |
| NL | 103727 | | 1/1963 |
| WO | WO 02/076276 | A1 | 10/2002 |

* cited by examiner

*Primary Examiner*—Duane Smith
*Assistant Examiner*—Ives Wu
(74) *Attorney, Agent, or Firm*—Morrison & Foerster LLP

(57) ABSTRACT

An exhaust assembly for an appliance includes a filter housing for retaining a filter and an exhaust duct which receives airflow from the filter housing. One or more vanes are positioned in the filter housing for guiding airflow from the exhaust side of the filter to the exhaust duct. The vanes spread the airflow entering the exhaust duct across the width thereof so as to reduce noise and to reduce the velocity of the exiting air. The exhaust duct increases in cross-sectional area in the direction of flow through the exhaust duct so as to further reduce the velocity of the exiting air.

18 Claims, 9 Drawing Sheets

EXHAUST ASSEMBLY

FIELD OF THE INVENTION

The invention relates to an exhaust assembly. Particularly, but not exclusively, the invention relates to an exhaust assembly for use in a domestic appliance such as a vacuum cleaner.

BACKGROUND OF THE INVENTION

Vacuum cleaners are required to separate dirt and dust from an airflow. Dirt and dust-laden air is sucked into the appliance via either a floor-engaging cleaner head or a tool connected to the end of a hose and wand assembly. The dirty air passes to some kind of separating apparatus which attempts to separate dirt and dust from the airflow. Many vacuum cleaners suck or blow the dirty air through a porous bag so that the dirt and dust is retained in the bag whilst cleaned air is exhausted to the atmosphere. In other vacuum cleaners, cyclonic or centrifugal separators are used to spin dirt and dust from the airflow (see, for example, EP 0 042 723). Whichever type of separator is employed, there is commonly a risk of a small amount of dust passing through the separator and being carried to the fan and motor unit, which is used to create the flow of air through the vacuum cleaner whilst it is in operation. Also, with the majority of vacuum cleaner fans being driven by a motor with carbon brushes, such as an AC series motor, the motor emits carbon particles which are carried along with the exhaust flow of air.

In view of this, it is common for a filter to be positioned after the motor and before the point at which air is exhausted from the machine. Such a filter is often called a 'post motor' filter.

There is an increasing awareness among consumers of the problem of emissions, which can be particularly problematic for asthma sufferers. Thus, recent vacuum cleaner models are fitted with filters which have a large surface area of filter material, and the filters often comprise several types of filter material and a foam pad. Such filters are physically bulky and housing such filters in the cleaner is quite challenging. A vacuum cleaner called the Dyson DC05, manufactured and sold by Dyson Limited, houses a circular post motor filter beneath the dirt collection bin. Air is ducted to a first face of the filter, passes through the filter, leaves the second face of the filter and exhausts from the machine via a set of apertures.

There is also a desire to increase the rate of flow of air through a vacuum cleaner. A higher rate of flow generally increases both the ability of the cleaner to pick up material from a surface and the ability of the cyclonic separator to separate material from the dirty airflow. However, an increased rate of airflow can cause the machine to be noisy in operation. It is possible to place acoustically absorbent material in the path of the exhaust air, but this increases the resistance of the path seen by the airflow. This has a detrimental effect on the overall rate of airflow through the machine in addition to adding both weight and cost to the machine.

SUMMARY OF THE INVENTION

The present invention seeks to provide an improved exhaust assembly. Accordingly, an aspect of the present invention provides an exhaust assembly for an appliance comprising a filter housing for receiving a filter, an exhaust duct communicating with the filter housing for carrying airflow from the filter housing, and at least one vane positioned within the filter housing for guiding airflow from the exhaust side of the filter to the exhaust duct so as to spread the airflow entering the exhaust duct across the width thereof.

The vanes help to more evenly distribute air across the full cross-section of the exhaust duct and thereby slow the exhaust airflow. This can help to reduce noise and can reduce the back pressure that a faster-flowing flow would otherwise cause. The arrangement is particularly beneficial in any exhaust assembly where the exhaust duct is mounted in such a way that exhaust air, in use, will not readily distribute itself across the exhaust duct.

Preferably there are at least two vanes positioned within the filter housing and the vanes are spaced from one another in a cross-section through the proximal end of the exhaust duct. An increased number of vanes helps to more evenly distribute the exhaust airflow.

Preferably the vanes are carried by a cover of the filter housing. Preferably the filter housing comprises apertures for allowing some of the exhaust airflow to vent to atmosphere without passing through the exhaust duct. This helps to reduce the flow of air which needs to pass along the exhaust duct.

Preferably the exhaust duct increases in cross-sectional area in the direction of airflow through the exhaust duct.

Although this invention is described in relation to a cylinder (canister) vacuum cleaner, it will be apparent that it can be applied to other kinds of vacuum cleaner or domestic appliances.

BRIEF DESCRIPTION OF THE DRAWINGS

Embodiments of the invention will now be described with reference to the accompanying drawings in which.

DETAILED DESCRIPTION OF THE INVENTION

Figure 1:
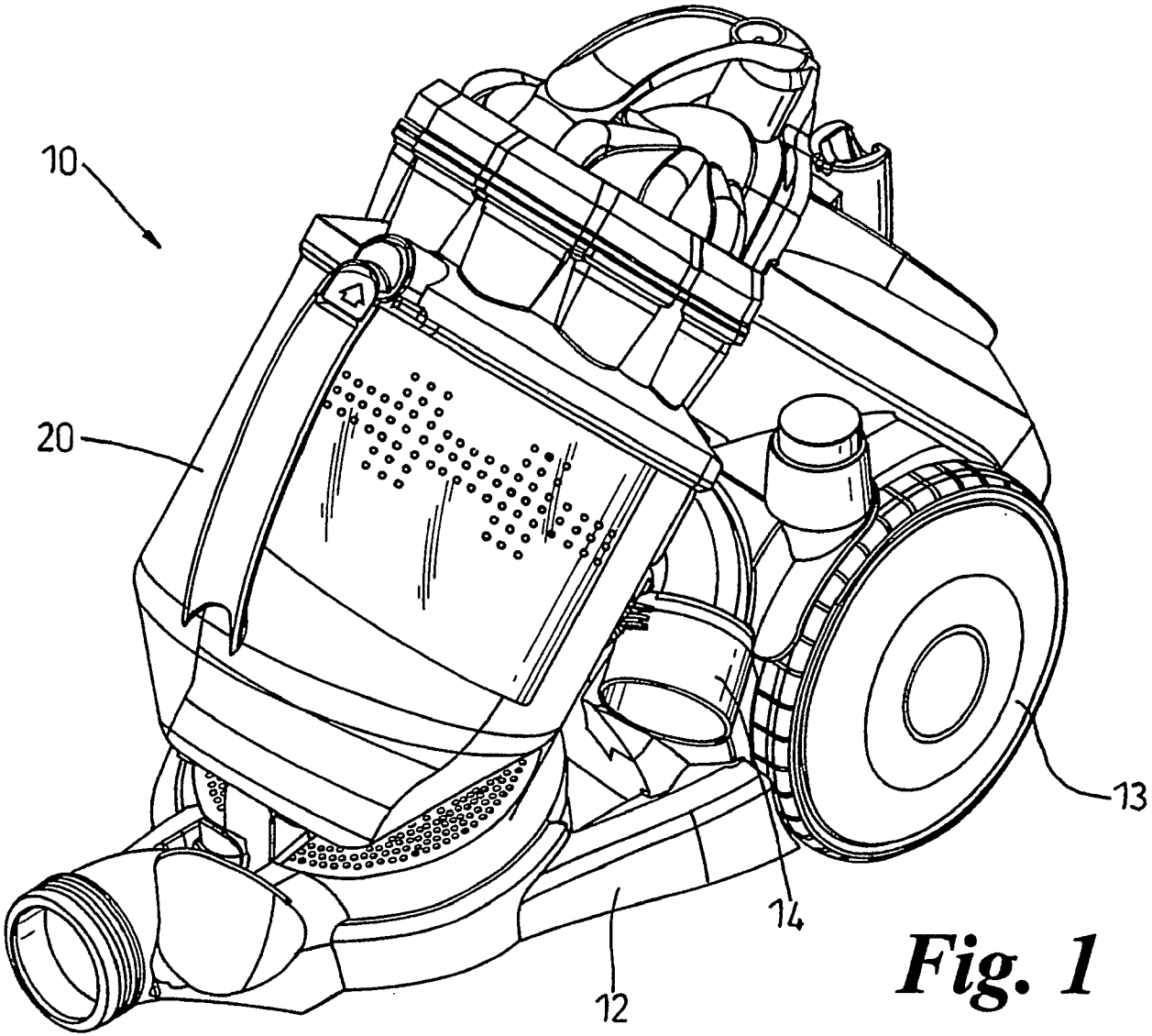
FIG. 1 is a perspective view of a vacuum cleaner in which a filter housing according to the invention is embodied.
Figure 2:
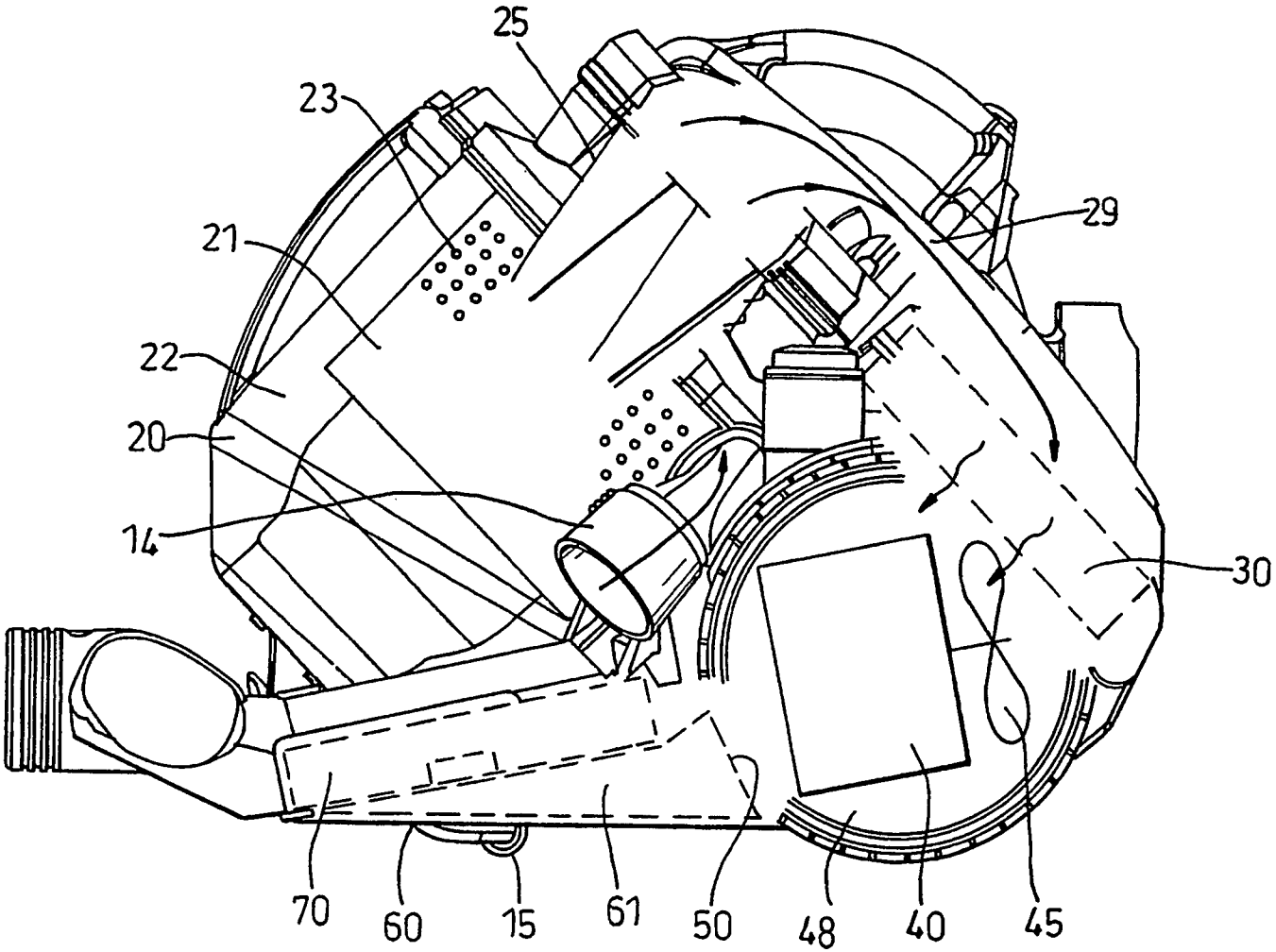
FIGS. 2 and 3 are side views of the vacuum cleaner of FIG. 1, showing some of the internal components of the cleaner.
Figure 3:
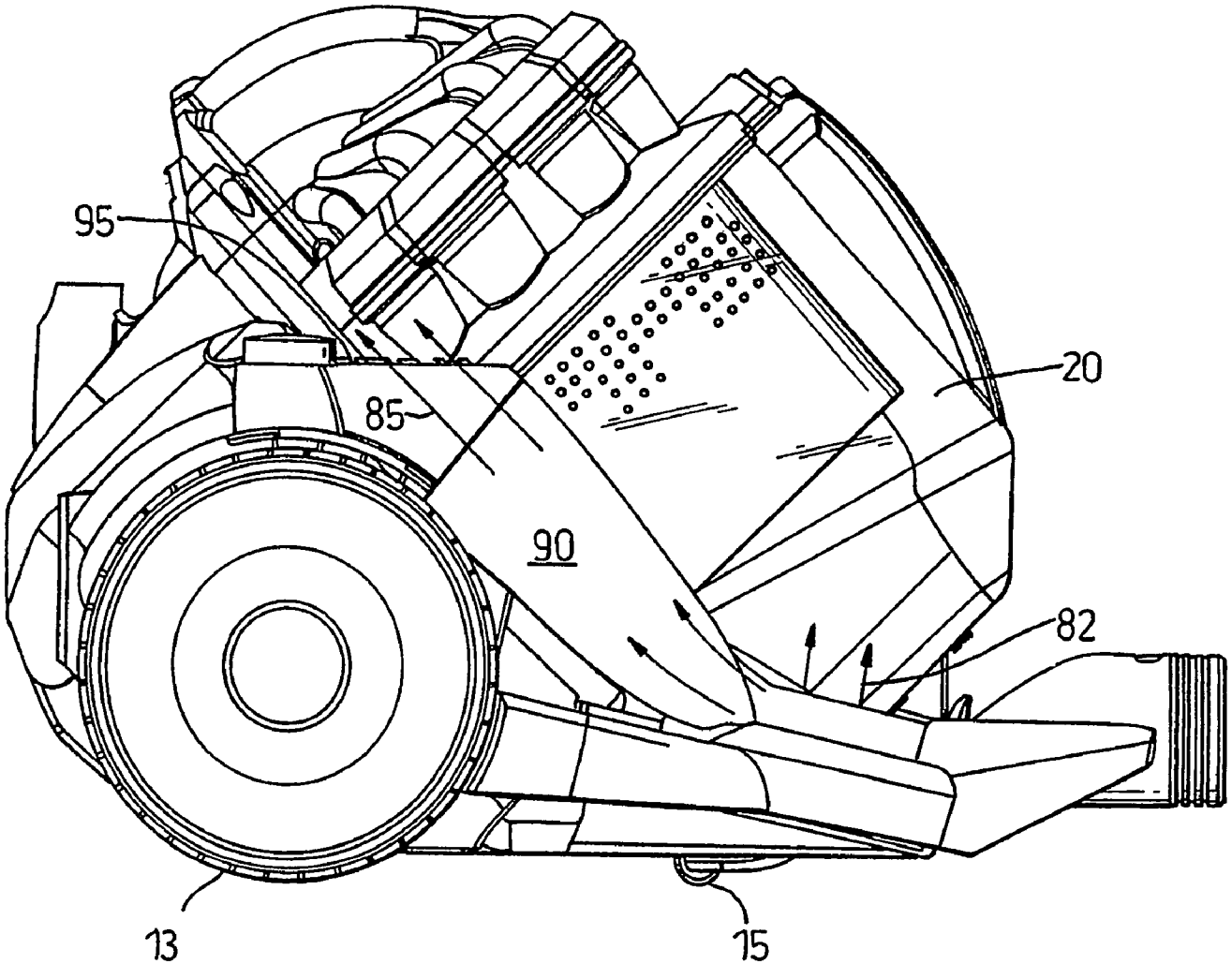

FIGS. 1 to 3 show an example of a vacuum cleaner 10 in which the invention is embodied. The vacuum cleaner 10 is a cylinder or canister type of vacuum cleaner comprising a chassis 12 with wheels 13, 15 for allowing the chassis 12 to be moved across a surface to be cleaned. The chassis 12 supports a chamber 20 which serves as a separator for separating dirt, dust and other debris from an airflow and also as a collector for the separated material. While a cyclonic separator is shown here, the separator can take any form and this is not important to the invention. Chamber 20 is removable from the chassis 12 such that a user can empty the chamber 20. Although not shown for reasons of clarity, a hose connects to inlet 14 of the vacuum cleaner 10 and a user can fit a wand or tools to the distal end of the hose for use in cleaning various surfaces.

FIGS. 2 and 3 show some of the internal components of the vacuum cleaner 10 of FIG. 1. The chamber 20 communicates with the inlet 14 through which an airflow can enter the chamber in a tangential manner. The chamber 20 has an apertured shroud 21 mounted centrally within it. The region 22 externally of the shroud 21 forms a first cyclonic separation stage. The apertures 23 in the shroud 21 communicate with a second cyclonic separation stage comprising a set of frusto-conical separators 25 arranged in parallel. The outlets of the second stage separators 25 are connected, via a duct 29, to a housing for a pre-motor filter 30. The pre-motor filter 30 serves to trap any fine dust or microscopic particles which have not been separated by the two cyclonic separation stages 22, 25. The downstream side of the pre-motor filter 30 communicates with a fan and motor housing 48. This housing 48 accommodates an impeller 45 which is driven by a motor 40. The outlet of the housing 48 communicates, via an aperture 50, with a filter housing 60. The filter housing 60 houses a post-motor filter 70 which serves to trap any particles remaining in the airflow, as well as carbon particles emanating from the motor 40. The downstream side of the filter housing 60 communicates with an exhaust duct 90 having outlet apertures 95 at its furthest end.

Figure 4:
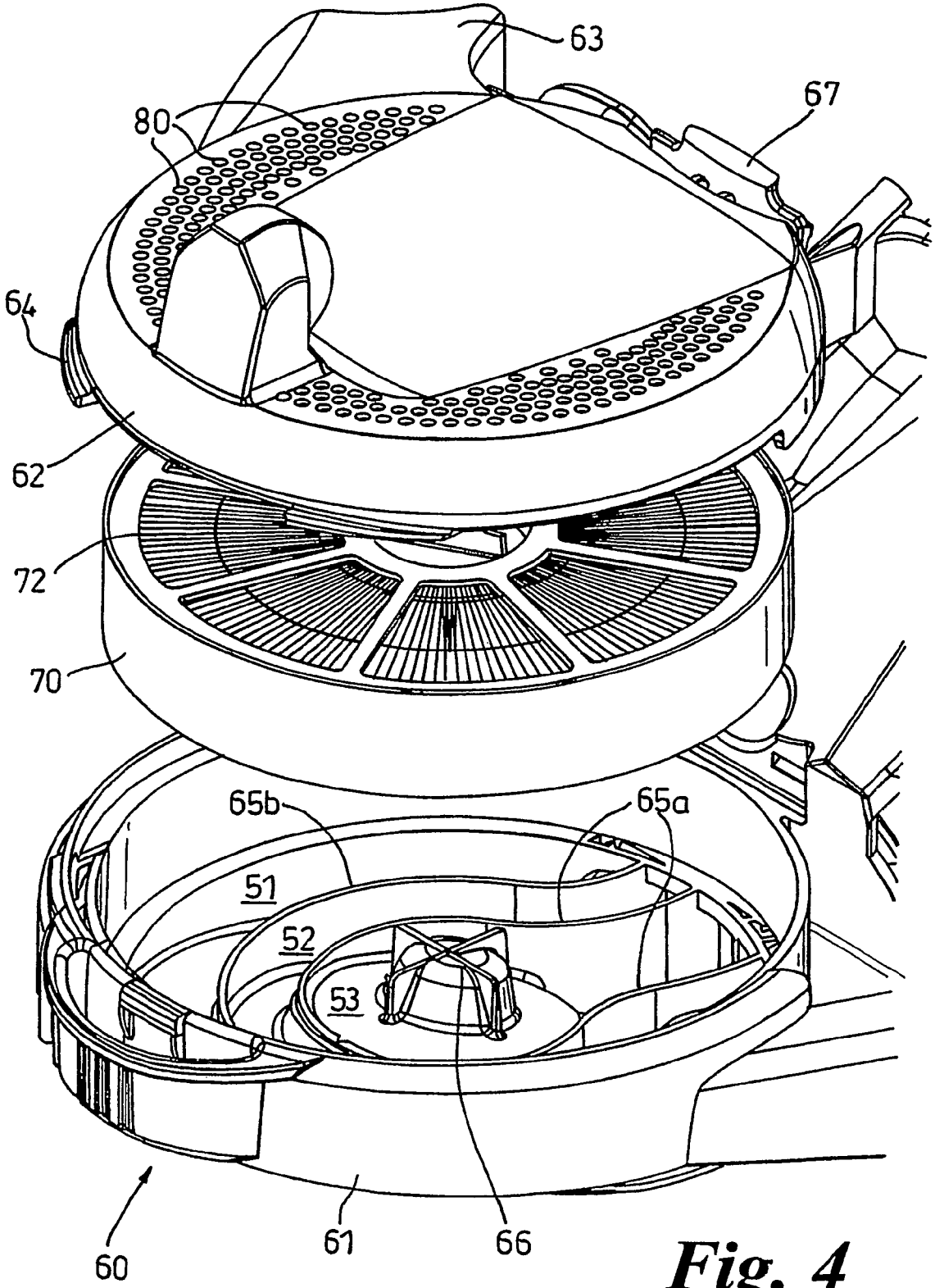
FIG. 4 shows the filter housing of the vacuum cleaner of FIGS. 1 to 3.

The filter housing 60 will now be described in more detail with reference to FIG. 4. The filter housing 60 comprises a lower part 61, which in this embodiment forms part of the chassis 12 of the vacuum cleaner 10, and an upper part 62. The upper part 62 fits removably to the lower part 61 by means of lugs 64 and a snap fastener 67. Other types of fastener could, of course, be used. The lower part 61 defines an airflow passage which communicates at its upstream end with the aperture 50 which forms the outlet from the housing 48. The space between the lower part 61 and the upper part 62 defines a cavity for housing the filter 70. The upper part 62 has an outlet branch 63 which mates, in an airtight manner, with the lower end of the exhaust duct 90.

A plurality of vanes 65*a*, 65*b*, 65*c* are located in the airflow passage. Two of the vanes 65*a*, 65*b* extend from the aperture 50 and into the area of the airflow passage which lies adjacent the cavity for receiving the filter 70. In this area, the vanes 65*a*, 65*b* extend from the lower part 61 towards the upper part 62 so that they lie adjacent, or even contact, the filter 70. A third vane 65*c* extends from the aperture 50 towards the area of the airflow passage which lies adjacent the cavity for receiving the filter 70 but terminates immediately before the said area. Three separate ducts 51, 52, 53 are formed between the vanes 65*a*, 65*b*, 65*c*.

Figure 5:
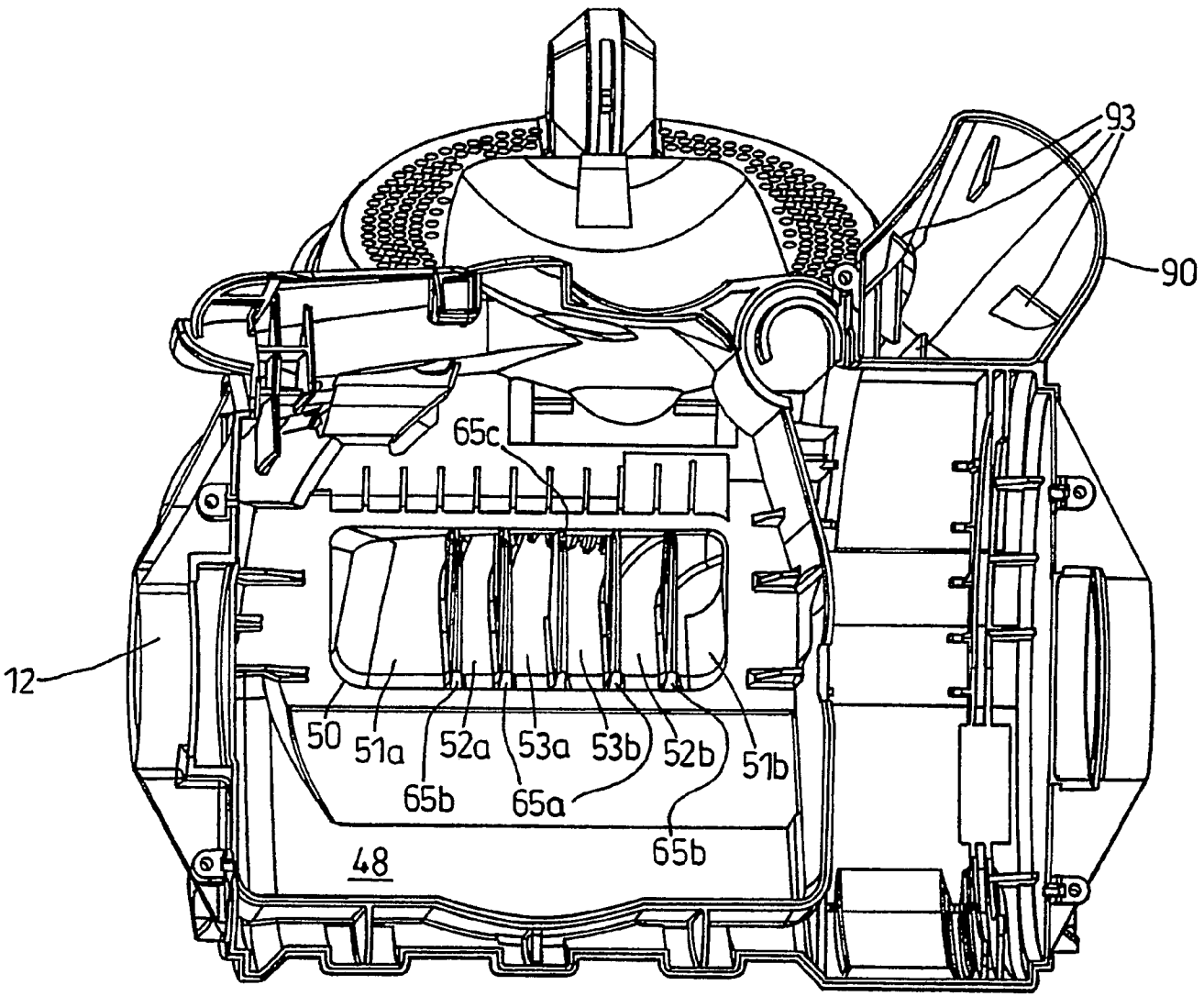
FIG. 5 shows the chassis of the vacuum cleaner and the conduit leading to the filter housing of FIG. 4.

The vanes 65*a*, 65*b*, 65*c* serve to guide the airflow passing through the vacuum cleaner 10 to and from the filter 70. The vanes 65*a*, 65*b*, 65*c* extend from the outlet 50 of the motor housing 48 along the lower surface of part 61. The vanes 65*a*, 65*b* continue beneath the area where filter 70 is located. The vanes 65*a*, 65*b*, 65*c* have two uses: firstly they serve to distribute airflow across the surface of the filter 70 in a reasonably uniform manner, and secondly they non-linear shape serves to attenuate sound from the impeller 45. Referring to FIG. 5, the vanes 65*a*, 65*b*, 65*c* divide outlet 50 into six apertures 51*a*, 51*b*, 52*a*, 52*b*, 53*a*, 53*b*. In use, this causes the flow of air from the impeller 45 to be divided into six separate flows. Each aperture 51*a*, 51*b*, 52*a*, 52*b*, 53*a*, 53*b* forms an inlet to one of the ducts 51, 52, 53. Each duct 51, 52, 53 communicates with a distinct and separate portion of the surface area of the filter 70. The height of each vane 65*a*, 65*b* is chosen such that the distal edges thereof lie adjacent to, and preferably touch, the surface of filter 70 when the filter is fitted into the housing 60. Thus, each duct 51, 52, 53 communicates with a separate and distinct portion of the filter 70 so that air flowing along each duct 51, 52, 53 is constrained to flow through the respective portion of the filter 70.

Referring again to FIG. 2 it can be seen that the upstream surface of the filter 70 lies, in use, at an acute angle (approximately 10°) with respect to the incoming airflow from the motor housing 48. The division of the airflow into separate portions in the manner just described helps to distribute the airflow evenly across the surface of the filter 70, even though the arrangement of the filter 70 with respect to the incoming airflow is not ideal for even distribution. It is particularly beneficial that each duct 51, 52, 53 serves a portion of the filter surface which is a different distance from the inlet 50; i.e. duct 51 serves the remote portion of the filter 70, duct 52 the middle section, and duct 53 the nearest portion of the filter surface 70.

Figure 6:
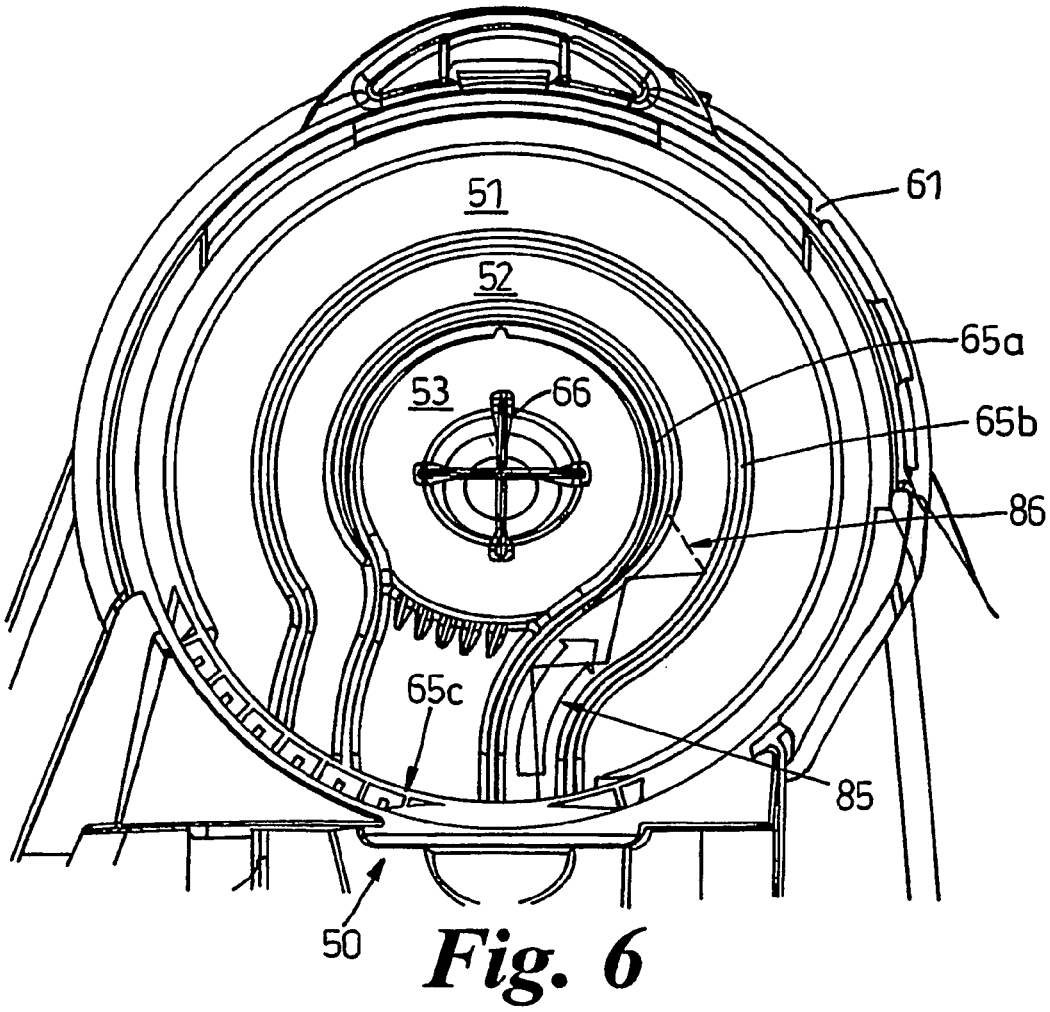
FIG. 6 is a plan view of the lower part of the filter housing of FIG. 4.

FIG. 6 shows the lower part 61 of the filter housing 60 in plan view. The path taken by the airflow along part of the duct 52 is shown by arrow 85 while the path taken by sound waves is shown by arrow 86. Due to the shape of the vanes 65*a*, 65*b*, it can be seen that the sound waves are forced to bounce between the vanes 65*a*, 65*b* on multiple occasions or at the very least provide an obstruction to sound waves emanating from the motor housing 48. Vanes 65*a*, 65*b*, 65*c* can be molded or otherwise formed integrally with the lower part 61 of the filter housing 60 or they can be provided as a separate part or set of parts which locate within the lower part 61 of the filter housing 60.

Figure 7:
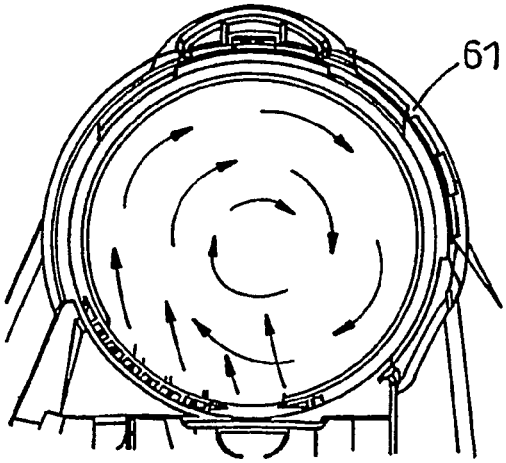
FIGS. 7 and 8 illustrate the effect of vanes in reducing swirl in the airflow.
Figure 8:
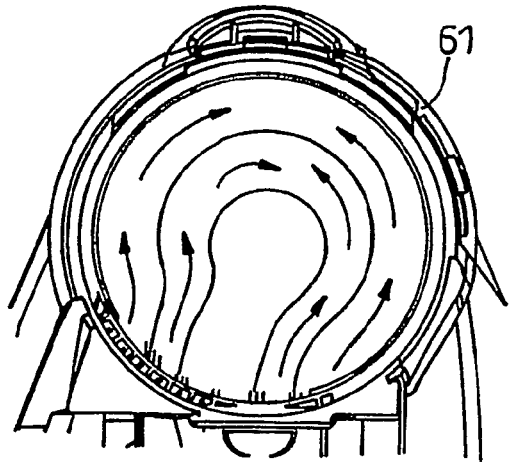

The provision of the vanes 65*a*, 65*b*, 65*c* described above is also particularly beneficial where the airflow inlet 50 is off-centre with respect to the filter housing 60. FIG. 7 shows the expected airflow without the presence of vanes of this sort. Air enters the filter housing 60 and swirls around the housing. This swirling airflow can cause added noise and can further reduce suction power. FIG. 8 shows the effect of positioning vanes 65*a*, 65*b* within the filter housing 60. Air entering the filter housing 60 is now unable to swirl to any noticeable degree.

Figure 9:
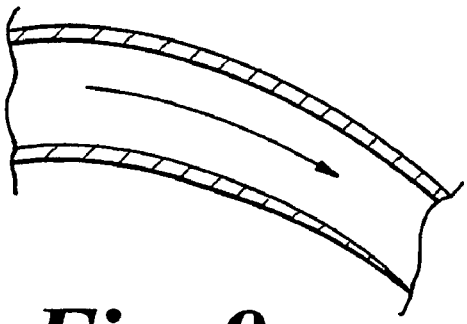
FIGS. 9 and 10 illustrate the effect of the shape of the vanes in the filter housing of FIG. 6.
Figure 10:
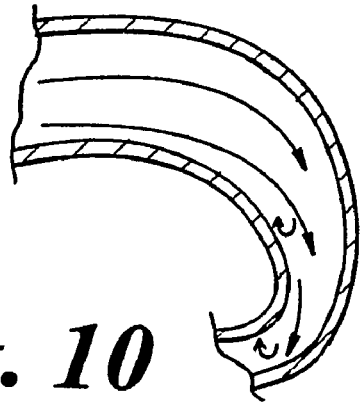

The shape of the vanes 65*a*, 65*b*, 65*c* ensures a smooth transition between directions and section changes which helps to avoid 'break away' and turbulence which increase noise and back pressure. It is particularly desirable to minimise back pressure in a vacuum cleaner as it reduces suction power. FIGS. 9 and 10 show the effect of 'break away' airflow by contrasting a smoothly curved duct (FIG. 9) with a duct which is curved too sharply (FIG. 10).

The position of the vanes 65*a*, 65*b*, 65*c* within the outlet aperture 50 of the motor housing 48 is chosen such that the cross sectional area of the inlet to each duct 51, 52, 53 is substantially proportional to the surface area of the filter portion served by that duct. This helps to ensure that the airflow is evenly distributed across the filter surface. The provision of two inlets to each duct (e.g. inlets 51*a*, 51*b* to duct 51) also helps to balance the airflow to the filter.

Filter 70 is shown here as a pleated filter, in which a cylindrical plastic case houses a pleated structure 72. Other types of filter, e.g. a simple foam pad filter, could be used in place of what has been shown here. Preferably the post-motor filter is a HEPA (High Efficiency Particulate Air) filter.

Figure 11:
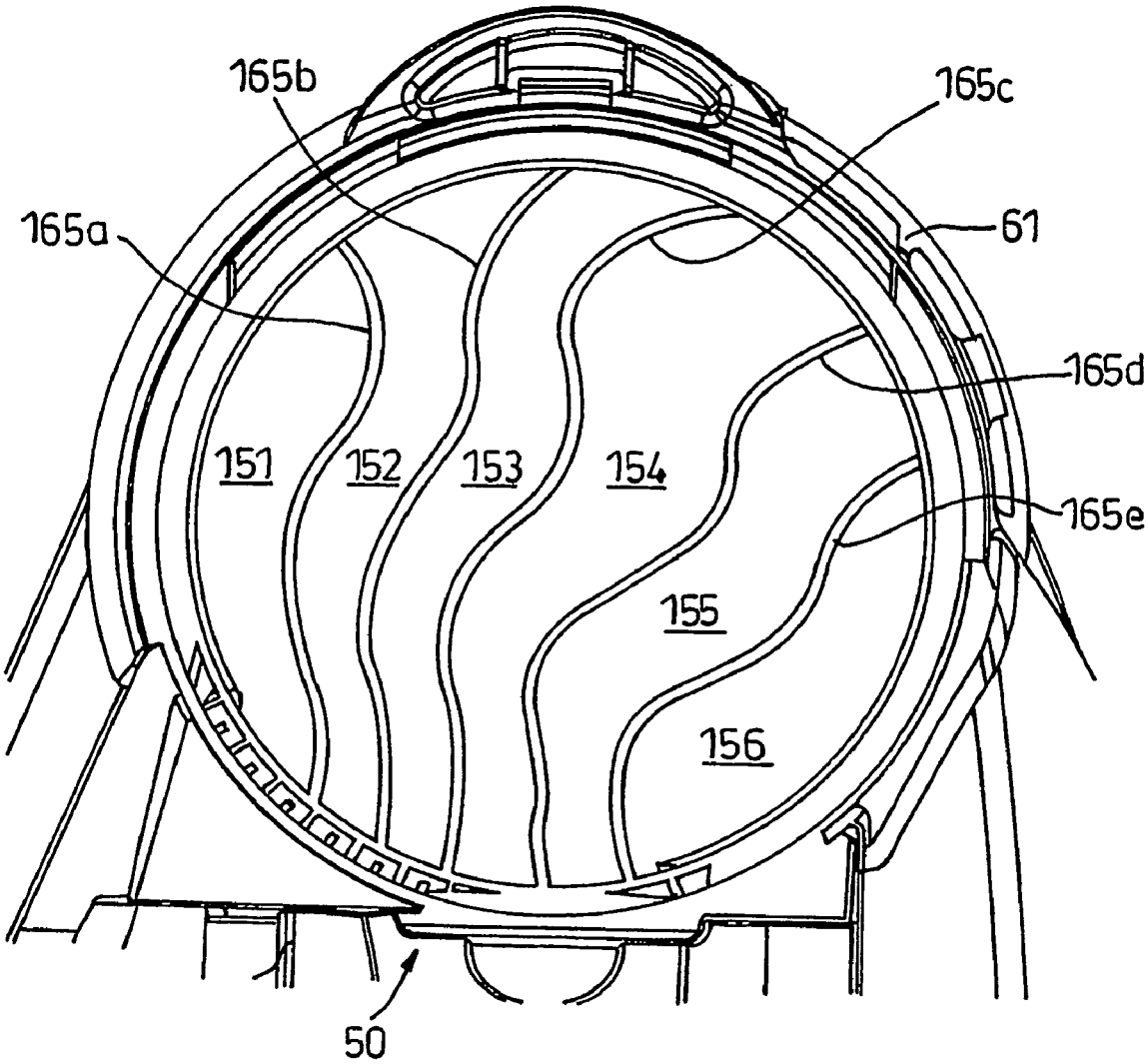
FIG. 11 is a plan view of an alternative embodiment of the lower part of the filter housing.

FIG. 11 shows a plan view of an alternative embodiment of the lower part 61 of the filter housing 60. In this embodiment, a set of vanes 165*a*-165*e* are positioned in a different manner to that shown in FIG. 6. Here, the vanes 165*a*-165*e* extend outwardly from the outlet aperture 50 of the motor housing 48 towards the furthermost side of the lower part 61 of the filter housing 60. As before, this arrangement of vanes divides the area beneath the filter 70 into a plurality of ducts 151-156, each duct communicating with a different portion of the filter surface. Each vane has a non-linear, sinuous shape which enhances the likelihood of sound waves colliding with at least one of the vanes. In use, incoming airflow will be divided into a plurality of separate portions, each portion flowing along a respective duct. As before, the cross-section of each inlet is proportional to the filter area served by the inlet.

Figure 12:
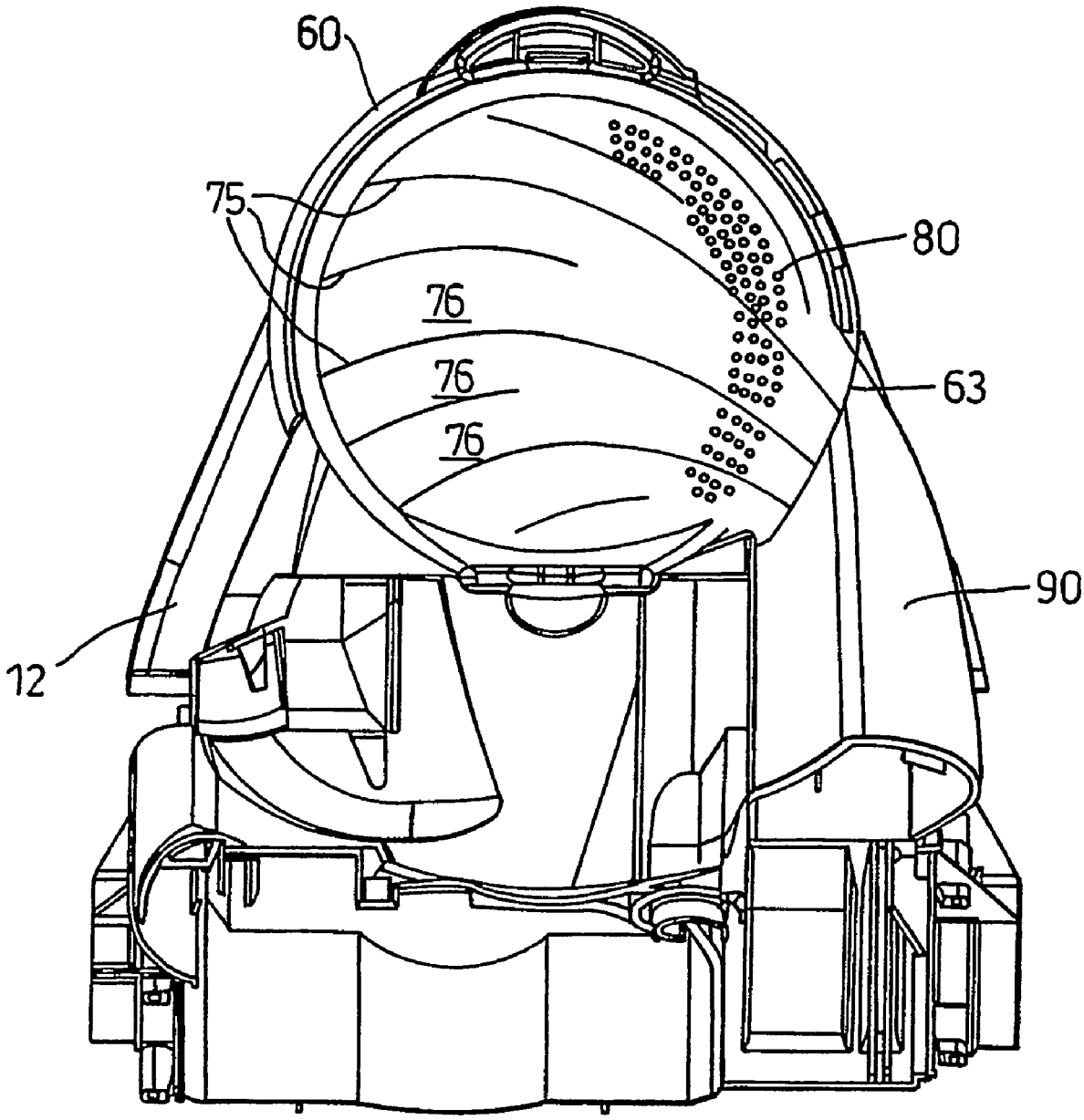
FIG. 12 illustrates the position of vanes in the exhaust part of the filter housing.
Figure 13:
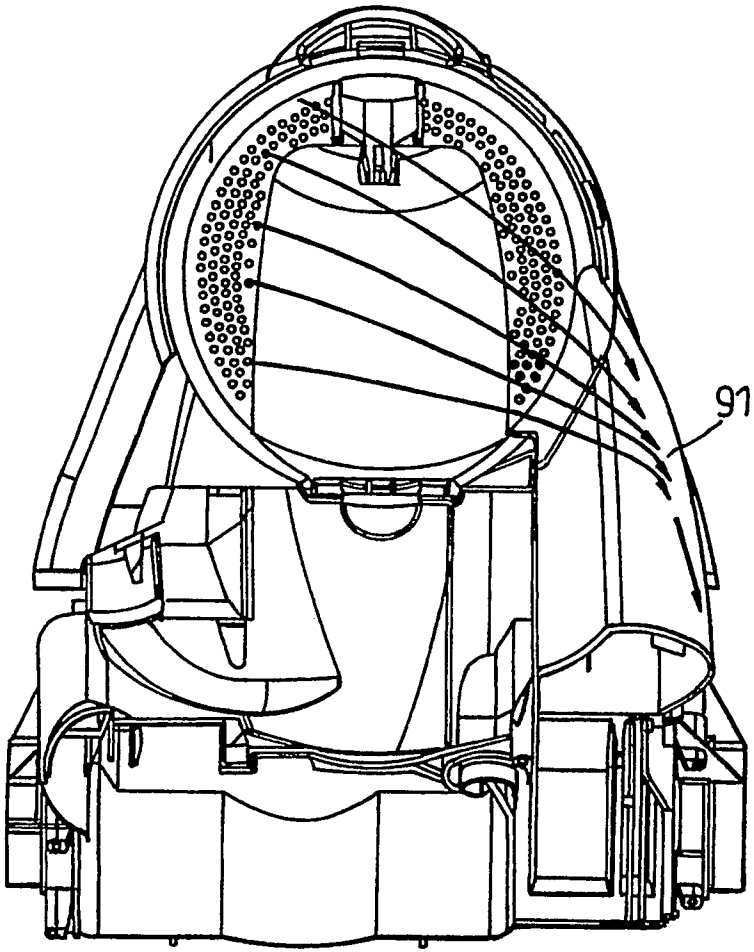
FIG. 13 shows an expected pattern of the airflow leaving the filter housing, in the absence of any directional vanes in the exhaust part of the filter housing.

The exhaust side of the filter 70 will now be described with reference to FIGS. 12 to 14. FIG. 12 is a plan view of the chassis 12 and filter housing 60. A set of vanes 75 is provided on the underside of the upper part 62 of the filter housing 60. The vanes 75 serve to guide the airflow leaving the exhaust side of the filter 70 toward the exhaust duct 90 in a manner which distributes the airflow across the full width of the exhaust duct 90. This is best illustrated with reference to FIGS. 13 and 14. FIG. 13 shows the expected path of exhaust airflow without the use of vanes 75. Exhaust airflow 91 is concentrated near the outermost surface of the exhaust duct 90. This concentration of the airflow results in a high speed, localised flow of exhaust air along the outermost surface of the exhaust duct 90. This will have two annoying effects: (i) the flow of air exiting from the machine will cause disturbance to a user and to the immediate surroundings of the machine, and (ii) it will cause additional noise disturbance.

Figure 14:
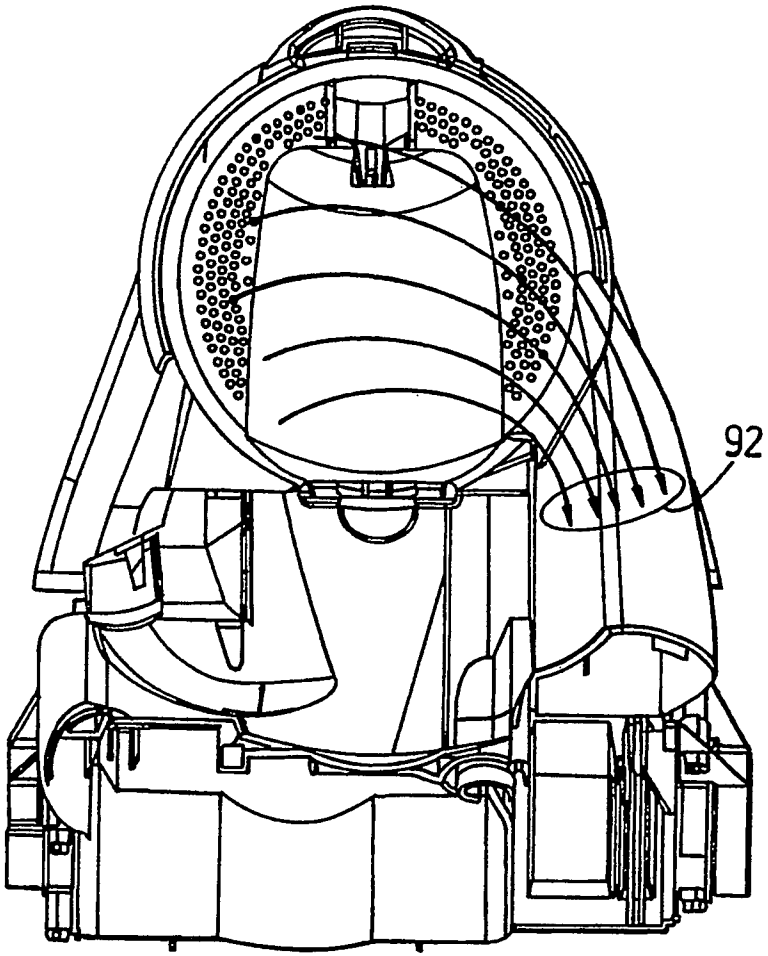
FIG. 14 shows the expected pattern of the airflow leaving the filter housing when the vanes of FIG. 12 are employed.

FIG. 14 shows the effect of using the vanes 75 shown in FIG. 12. Here, the exhaust airflow 92 is much more evenly distributed across the exhaust duct 90. This results in the flow of air exiting the outlet 95 of the exhaust duct 90 having a reduced peak velocity. This leads to the vacuum cleaner being quieter and presenting a lower back pressure to the upstream components of the vacuum cleaner 10. The vanes 75 can be molded or otherwise formed integrally with the upper part 62 of the filter housing 60.

In addition to the use of vanes 75, the exhaust duct 90 itself has an outwardly tapering shape, i.e. the cross-section of the exhaust duct 90 increases in the direction of flow of the exhaust air. This outwardly tapering shape serves to reduce further the speed of the airflow from the outlet 95 of the exhaust duct 90. This tapering is gradual so as to slow the air without causing additional flow separations. Exhaust duct 90 also has vanes 93 (see FIG. 5) mounted inside the duct. These vanes 93 extend inwardly from the outer surface of the duct 90 and can be used to support a foam sound reducing pad if this is required.

The operation of the vacuum cleaner will now be described. In use, air is drawn by the motor-driven impeller 45, through any floor tool and hose into inlet 14 of the vacuum cleaner 10. The dirty air passes through the cyclonic separation stages 22, 25, during which dirt and dust is separated from the airflow in a manner which is well documented elsewhere. Air flows from the outlet of cyclones 25, along duct 29, through pre motor filter 30 and into the motor housing 48. Exhaust air is blown towards aperture 50 and is divided into six portions by the leading edges of the vanes 65*a*, 65*b*, 65*c*. The divided portions of the airflow flow along the three ducts 51, 52, 53. As described above, acoustic waves bounce along the ducts 51, 52, 53, between opposing vanes 65. Airflow from the ducts eventually passes through the portion of the post-motor filter 70 which lies above the respective duct 51, 52, 53. After passing through the filter 70, air is constrained by the vanes 75 to flow towards the inlet to the exhaust duct 90. The vanes 75 ensure that the airflow arriving at the inlet to the exhaust duct 90 is distributed across the full width of the exhaust duct 90. Some of the air vents to atmosphere via apertures 80 in the upper face of the filter housing part 62 (see arrows 82, FIG. 3). The remainder of the air flows along the exhaust duct 90. As the air flows along the exhaust duct 90, it slows down because the duct 90 widens in the direction of flow. This air vents to atmosphere via apertures 95 (see arrows 85, FIG. 3).

The invention claimed is:

1. An appliance, comprising:

a dust separator;

a filter housing located downstream from the dust separator and including a filter therein; and an exhaust duct configured to carry airflow from the filter housing, wherein the filter housing comprises at least one substantially non-linear vane positioned downstream of the filter for guiding airflow from an exhaust side of the filter to an inlet of the exhaust duct so as to spread airflow entering the exhaust duct across the width thereof, wherein the exhaust duct further comprises an airflow outlet to discharge the airflow from the device, and wherein the vane is positioned such that it is spaced from side walls of the exhaust duct in a cross-section through the proximal end of the exhaust duct.

2. An appliance, comprising:

a dust separator;

a filter housing located downstream from the dust separator and including a filter therein; and an exhaust duct configured to carry airflow from the filter housing, wherein the filter housing comprises at least one substantially non-linear vane positioned downstream of the filter for guiding airflow from an exhaust side of the filter to an inlet of the exhaust duct so as to spread airflow entering the exhaust duct across the width thereof, wherein the exhaust duct further comprises an airflow outlet to discharge the airflow from the device, and wherein at least two vanes are positioned within the filter housing and wherein the vanes are spaced from one another in a cross-section through the proximal end of the exhaust duct.

3. An appliance according to claim 1 or 2, wherein the vanes are dimensioned such that they lie adjacent to a surface of the filter, when the filter is mounted within the housing, whereby to define outlet ducts for the airflow.

4. An appliance according to claim 1 or 2, wherein the filter housing comprises a cover portion and wherein the vanes are carried by the cover.

5. An appliance according to claim 4, wherein the vanes are formed integrally with the cover.

6. An appliance according to claim 4, wherein the cover is configured to be removable from the filter housing for allowing access to the filter.

7. An appliance according to claim 1 or 2, wherein the filter housing comprises apertures for allowing exhaust airflow to vent to atmosphere without passing through the exhaust duct.

8. An appliance according to claim 1 or 2, wherein the exhaust duct increases in cross-sectional area in the direction of airflow through the exhaust duct.

9. An appliance according to claim 1 or 2, further comprising a body of sound reducing material mounted within the exhaust duct.

10. An appliance according to claim 1 or 2, wherein the exhaust duct is aligned in a direction which is non-normal to the plane in which the filter surface lies.

11. A vacuum cleaner comprising a device inlet, the appliance according to claim 1 or 2, and an airflow generator for generating a flow of air through the appliance from the device inlet to the exhaust assembly.

12. An appliance according to claim 3, wherein the filter housing comprises apertures for allowing exhaust airflow to vent to atmosphere without passing through the exhaust duct.

13. An appliance according to claim 4, wherein the filter housing comprises apertures for allowing exhaust airflow to vent to atmosphere without passing through the exhaust duct.

14. A vacuum cleaner comprising a device inlet, the appliance according to claim 3 and an airflow generator for generating a flow of air through the appliance from the device inlet to the exhaust assembly.

15. A vacuum cleaner comprising a device inlet, the appliance according to claim 4 and an airflow generator for generating a flow of air through the appliance from the device inlet to the exhaust assembly.

16. An appliance according to claim 3, wherein the exhaust duct increases in cross-sectional area in the direction of airflow through the exhaust duct.

17. An appliance according to claim 4, wherein the exhaust duct increases in cross-sectional area in the direction of airflow through the exhaust duct.

18. An appliance, comprising:

a dust separator;

a filter housing located downstream from the dust separator and including a filter therein; and an exhaust duct configured to carry airflow from the filter housing, wherein the filter housing comprises at least one substantially non-linear vane configured to contact an exhaust side of the filter and to guide airflow from the filter to an inlet of the exhaust duct such that the airflow is spread across a width of the inlet of the exhaust duct, wherein the exhaust duct further comprises an airflow outlet to discharge the airflow from the device, and wherein the vane is positioned such that it is spaced from side walls of the exhaust duct in a cross-section through the proximal end of the exhaust duct.

* * * * *